United States Patent [19]

Arkens

[11] 4,289,823

[45] Sep. 15, 1981

[54] CALENDERABLE ACRYLIC POLYMERS AND TEXTILES TREATED THEREWITH

[75] Inventor: Charles T. Arkens, Hatfield, Pa.

[73] Assignee: Rohm and Haas Company, Philadelphia, Pa.

[21] Appl. No.: 192,165

[22] Filed: Sep. 30, 1980

[51] Int. Cl.[3] ..... B32B 7/00

[52] U.S. Cl. ..... 428/245; 260/29.6 RW; 428/248; 428/252; 428/264; 428/265; 428/284; 428/286; 428/310; 428/315; 428/407; 525/296; 525/902

[58] Field of Search ..... 260/29.6 RW, 29.6 RB; 525/296, 301, 902; 428/245, 252, 248, 264, 265, 284, 286, 310, 315, 407

[56] References Cited

U.S. PATENT DOCUMENTS

| | | | |
|---|---|---|---|
| 3,458,603 | 7/1969 | Griffin | 525/301 |
| 3,461,188 | 8/1969 | Baer | 525/290 |
| 3,745,196 | 7/1973 | Lane et al. | 525/292 |
| 3,787,522 | 1/1974 | Dickie et al. | 525/286 |
| 3,793,402 | 2/1974 | Owens | 525/307 |
| 3,812,205 | 5/1974 | Dunkelberger | 525/307 |
| 3,843,753 | 10/1974 | Owens | 525/282 |
| 3,971,835 | 7/1976 | Myers et al. | 525/81 |
| 4,086,296 | 4/1978 | Carty et al. | 525/309 |
| 4,107,120 | 8/1978 | Plamondon et al. | 260/29.6 RB |
| 4,181,764 | 1/1980 | Plamondon et al. | 428/253 |

*Primary Examiner*—James J. Bell
*Attorney, Agent, or Firm*—Lester E. Johnson

[57] ABSTRACT

There is disclosed a calenderable, soft, three-stage acrylic heteropolymer having a calculated $T_g$ of about (−) 40° to (+) 20° C. which is suitable for producing films and sheets useful to coat textile materials and other substrates to form composites. The heteropolymer can be coagulated and then introduced into a calendering apparatus to produce films and sheets at substantially lower temperatures than are required for calendering vinyl halide polymers.

10 Claims, No Drawings

CALENDERABLE ACRYLIC POLYMERS AND TEXTILES TREATED THEREWITH

BACKGROUND OF THE INVENTION

1. Field of the Invention

This invention relates to multi-stage acrylic polymeric compositions, to a process of producing films and sheets by calendering the multi-stage acrylic polymeric compositions, to composites of coated textile materials and other substrates wherein the coating is a film or sheet of the calendered multi-stage acrylic polymer composition, and to a process of treating a textile material or other substrate with sheets of films of the calendered multi-stage acrylic polymeric compositions. The use of the compositions according to the invention provides improvement of various properties of textile materials treated therewith, such as flexibility and a leather-like hand while retaining good low-temperature properties.

2. Prior Art And Related Applications

The use of calenders for processing synthetic thermoplastic materials to produce films or sheets is well-known. The state of the art of calendering synthetic thermoplastic materials is described in the following: "Calendering," Eberhart Meinicke, pages 802–819 in Herman F. Mark, Norman G. Gaylord, and Norman M. Bikales, eds., *Encyclopedia of Polymer Science and Technology,* Volume 2, Interscience Division, John Wiley & Sons, New York, 1965; "Calendering," G. W. Eighmy, Jr., pages 237–238 in *Modern Plastics Encyclopedia,* 1978–1979; "Calendering Today Isn't Just Vinyls," pages 61–63 in *Modern Plastics,* June 1974; and "Calendering," G. W. Eighmy, page 451 in *Modern Plastics Encyclopedia,* 1970–1971.

The bulk of thermoplastic materials processed on calenders is poly(vinyl chloride), sometimes referred to hereafter as PVC. Other thermoplastic materials more recently used in calendering operations include acrylonitrile-butadiene-styrene polymer-modified PVC and polyethylene-modified PVC, cellulose acetate, polyolefins including polyethylene, chlorinated polyethylene and polypropylene, and polyurethane elastomers. Interest in the use of non-PVC synthetic thermoplastic materials has been increasing due to environmental and ecological considerations which favor decreasing the use of PVC and of plasticizers normally used with PVC. Although many synthetic thermoplastic materials have been used heretofore in place of PVC in calendering operations, the use of soft and flexible acrylic polymeric materials as the predominant thermoplastic material is not known for the production of films and sheets by calendering, the films and sheets thereby produced being useful for coating fabrics and textiles or other substrates to produce composites having applications such as home furniture upholstery, automotive upholstery, clothing fabric, luggage, wall covering, and the like.

Applicant's copending application, U.S. Ser. No. 945,733, filed Sept. 25, 1978, discloses a textile treating composition and an article comprising a textile material treated therewith, wherein the textile treating composition comprises an acrylic latex, the particles of which comprise about 30–60% by weight of polymeric core and about 70–40% by weight of a polymeric shell, wherein said core is formed by emulsion polymerization of a first monomer composition consisting essentially of:

70–95% by weight of $C_1$–$C_8$ alkyl acrylate,
0–15% by weight of a $C_1$–$C_8$ alkyl methacrylate,
4–10% by weight of acrylamide or methacrylamide,
0–0.3% by weight of allyl methacrylate, and
0–2% by weight of itaconic acid;

and wherein said shell is formed on said core by emulsion polymerization of a second monomer composition in the presence of said core, said second monomer composition consisting essentially of:

40–70% by weight of a $C_1$–$C_8$ alkyl acrylate,
20–50% by weight of a $C_1$–$C_8$ alkyl methacrylate,
2–10% by weight of N-methylolacrylamide, N-methylol methacrylamide, or a mixture of methacrylamide and N-methylolacrylamide,
and 0–2% by weight of itaconic acid.

Commonly assigned U.S. Pat. No. 4,107,120 and U.S. Pat. No. 4,181,769 to Plamondon, the later being a division of the former (U.S. Pat. No. 4,107,120), disclose a textile treating composition and an article comprising a textile material treated therewith, wherein the textile treating composition consists essentially of an acrylic latex, the particles of which comprise about 30–60% by weight of a polymeric core and about 70–40% by weight of a polymeric shell, wherein the core is formed by emulsion polymerization of a first monomer composition consisting of:

(a) a major amount of a principal monomer system, and
(b) a minor amount of a crosslinking monomer system comprising:
(i) about 0.5% to 6% by weight on the total first monomer composition of a graftlinking monomer or an active crosslinking monomer, and
(ii) about 4% to 10% by weight on the total first monomer composition of a latent crosslinking monomer; and wherein said shell is formed on said core by emulsion polymerization of a second monomer composition in the presence of said core, said second monomer composition consisting essentially of:
(a) a major amount of a principal monomer system; and
(b) about 2% to 10% on the total second monomer composition of a latent crosslinking monomer; the monomers of said first monomer composition being selected to provide a $T_g$ in said core of −20° C. or lower, and the monomers of said second monomer composition being selected to provide a $T_g$ in said shell of about 60° C. to about −10° C.

Carty, U.S. Pat. No. 4,086,296, discloses a blend of a thermoplastic polymer (e.g. ABS resins, polystyrene, polypropylene, polyesters such as polyethylene terephthalate, polyamides such as poly[caprolactam] and polyurethanes which are mentioned in column 6, lines 23 to 60) with a multiphase acrylic composite polymer, the latter functioning as a lubricant and/or processing aid in the above-mentioned thermoplastic polymers.

Lane et al, U.S. Pat. No. 3,745,196, disclose a poly-stage elastomer having a first stage polymer having a glass temperature below about −35° C. comprising at least 50% by weight of an alkyl acrylate and, optionally, 0 to 5% by weight of a polyethylenically unsaturated crosslinking comonomer, 0 to 10% by weight of a curing site-containing monomer, and from 0 to 50% by weight of at least one monomer selected from alkoxyalkyl acrylates, alkylthioalkyl acrylates, cyanoalkoxyalkyl acrylates, and nitrile substituted alkyl acrylates. The final stage of the elastomer comprises at least 60% by weight of ethyl acrylate and/or methyl acrylate and, optionally, 0 to 40% by weight of comonomers such as acrylonitrile, lower ($C_1$–$C_4$) alkyl esters of acrylic acid and curing—site monomers.

Griffin, U.S. Pat. No. 3,458,603 discloses a three-stage granular polymerization process for the production of thermoplastic polymer materials suitable for injection molding to manufacture various molded articles.

Dickie, U.S. Pat. No. 3,787,522, discloses a particulate thermoplastic material having at least two stages formed by emulsion polymerization and having a rubber-like core of a major amount of an alkyl acrylate and a minor amount of a polyethylenically unsaturated compound as a crosslinking agent and a glass-like outer shell of about 30 to 99 molar parts of methyl methacrylate and about 1 to 70 molar parts of monomers copolymerizable with methyl methacrylate. The polymers are useful as modifiers of thermoset polymers and as intermediates for forming other rubber-like and/or rubber-modified materials suitable for molding with each other and with other thermoplastic materials.

Myers, U.S. Pat. No. 3,971,835, discloses a three-stage, sequentially produced graft copolymer comprising a non-rubbery, hard first stage polymer of 50 to 100 weight percent of a vinyl aromatic compound, 0 to 50 weight % of a different monovinylidene monomer and 0 to 10 weight % of a polyfunctional crosslinking monomer; a second stage rubbery polymer of 50 to 100 weight % of butadiene, isoprene, chloroprene, and an alkyl acrylate or mixtures thereof wherein the alkyl group has about 3 to 8 carbon atoms, 0 to 50 weight % of a monovinylidene monomer and 0 to 10 weight % of a polyfunctional crosslinking agent; and a third stage polymer of 50 to 100 weight % of an alkyl methacrylate wherein the alkyl group has 1 to 4 carbon atoms, 0 to 50 weight % of a vinylidene monomer, and 0 to 10 weight % of a polyfunctional crosslinking monomer. The 3-stage graft polymer is used as a modifier for vinyl halide polymers.

Owens, U.S. Pat. No. 3,793,402 and 3,843,753, discloses broadly acrylic heteropolymers having two or more stages.

Although the polymer compositions mentioned above generally provide excellent properties when used as latex coatings on fabrics or as processing aids for handling other polymers such as poly(vinyl chloride), they possess deficiencies which do not permit their use as thermoplastic materials for calendering into films or sheets.

SUMMARY OF THE INVENTION

It has now been discovered that a certain class of acrylic polymers is particularly suited for use as the thermoplastic material in calendering operations to produce films and sheets which can be used to produce coated fabrics or other substrates.

For a polymer to be calenderable, it must have a high degree of thermoplasticity. Under the stress of calendering rolls a polymer requires a balance between softening point, heat stability and flow. A softened polymer must be able to flow adequately to give the desired film, but it must still have sufficient integrity to be transferred from one roll to another, a property called "nerve" in the art. A polymer must have some degree of "pseudo-crosslinking" or internal interaction to give its mass some integrity. Such interaction can arise from entanglement of the polymer mass, some degree of crystallinity (as occurs in the case of PVC) or low degree of crosslinking, or combinations of the above. In addition to these basic inherent polymer responses, other properties, such as low tack, fluxing characteristics, degradation, and the like, can be controlled by the use of various additives to formulations of the polymers, as is known in the art. Ideally, the use of such additives should be minimized.

It is an object of the invention to provide a calenderable acrylic composition, to provide a calendered acrylic film or sheet, to provide textile materials treated with the calendered acrylic film or sheet, and to provide processes for producing the film or sheet by calendering the acrylic composition and for producing the treated textile materials.

These objects, and others as will become apparent, are achieved by the present invention which comprises, in one aspect, a calenderable, soft, three-stage acrylic polymeric composition, said composition having a calculated $T_g$ of from about (−) 40° C. to about (+) 20° C., the isolated and dried particles of which comprise about 30–60% by weight of a polymeric first stage, about 30–60% by weight of a polymeric second stage, and about 5–20% by weight of a polymeric third stage, wherein (1) said first stage is formed by emulsion polymerization of a first monomer composition having a $T_g$ of about (−) 10° C. or lower consisting essentially of:
  (a) about 70–95% by weight of at least one ($C_1$–$C_8$) alkyl acrylate,
  (b) about 0–15% by weight of at least one ($C_1$–$C_8$) alkyl methacrylate,
  (c) about 4–10% by weight of a latent cross-linking monomer selected from acrylamide or methacrylamide, and
  (d) about 0.5–4% by weight of at least one alpha, beta-ethylenically unsaturated carboxylic acid selected from acrylic acid, methacrylic acid, and itaconic acid;

(2) said second stage is formed by emulsion polymerization, in the presence of said first stage, of a second monomer composition having a $T_g$ of about (−) 10° to (+) 60° C. consisting essentially of:
  (a) about 40–70% by weight of at least one ($C_1$–$C_8$) alkyl acrylate,
  (b) about 20–50% by weight of at least one ($C_1$–$C_8$) alkyl methacrylate,
  (c) about 4–10% by weight of a latent crosslinking monomer selected from acrylamide and methacrylamide, and
  (d) about 0.5–4% by weight of at least one alpha, beta-ethylenically unsaturated carboxylic acid selected from acrylic acid, methacrylic acid, and itaconic acid; and (3) said third stage is formed by emulsion polymerization, in the presence of said second stage polymerization product, of a third monomer composition consisting essentially of:
  (a) about 50–100% by weight of methyl methacrylate, and
  (b) about 0–50% by weight of a comonomer selected from those comonomers copolymerizable with methyl methacrylate and having a calculated $T_g$ of less than 0° C.

In another aspect, this invention comprises a process for producing a film or sheet comprising calendering the composition of the invention.

In still another aspect, this invention comprises a process which comprises treating a textile material with the calendered film or sheet of the invention and curing the polymeric film on the textile material, with or without a crushed foam layer between the textile material and the coating.

In still further aspects, this invention comprises articles of manufacture produced by the processes of the invention.

DETAILED DESCRIPTION OF THE INVENTION

In this specification, the term "acrylic" is used in a general sense to describe polymers wherein a predominant proportion of the monomers is of the acrylic or methacrylic type, including acids, esters, amides and substituted derivatives thereof.

The first stage polymer is formed by emulsion polymerization of a first monomer composition having a $T_g$ of about (−) 10° C. or lower consisting essentially of (a) about 70–95% by weight of at least one ($C_1$–$C_8$) alkyl acrylate, preferably about 76–86% by weight of butyl acrylate, (b) about 0–15% alkyl methacrylate, preferably about 6–15% by weight of methyl methacrylate, (c) about 4–10% by weight of at least one of acrylamide or methacrylamide, preferably about 7% by weight of methacrylamide, and (d) about 0.5–4% by weight of at least one of acrylic acid, methacrylic acid, or itaconic acid, preferably about 1% by weight of itaconic acid.

The second stage polymer is formed by emulsion polymerization, in the presence of the first stage polymer, of a second monomer composition having a $T_g$ of about (−) 10° to (+) 60° C. consisting essentially of (a) about 40–70% by weight of at least one ($C_1$–$C_8$) alkyl acrylate, preferably about 47–57% by weight of butyl acrylate, (b) about 20–50% by weight of at least one ($C_1$–$C_8$) alkyl methacrylate, preferably 35–45% by weight of methyl methacrylate, (c) about 4–10% by weight of acrylamide or methacrylamide, preferably about 7% by weight of methacrylamide, and (d) 0.5–4% by weight of at least one of acrylic acid, methacrylic acid, or itaconic acid, preferably about 1% of itaconic acid.

The third stage polymer is formed by the emulsion polymerization, in the presence of the product of the second stage polymerization, of a third monomer composition consisting essentially of (a) about 50–100% by weight of methyl methacrylate, and (b) 0–50% by weight of a comonomer copolymerizable with methyl methacrylate, preferably 100% by weight of methyl methacrylate.

Part of the alkyl acrylate, up to a maximum of about 20% by weight, in the first and second monomer compositions may be replaced with non-crosslinking (with respect to the alkyl acrylate) monoethylenically unsaturated monomer having alpha, beta-ethylenic unsaturation. Examples of such comonomers include vinyl and vinylidene halides such as the chlorides; vinyl esters such as vinyl formate and acetate; mixtures of ethylene and the vinyl esters; (meth)acrylic esters of alcohol ethers such as diethylene glycol monoethyl ether; styrene and aromatic ring-alkyl styrenes; alpha olefins such as ethylene, butylene and propylene; vinyl ethers, and compatible mixtures thereof.

The same group of comonomers mentioned in the foregoing paragraph may also constitute the comonomers which may be used with methyl methacrylate in the third monomer composition.

The most preferred calenderable acrylic composition of the invention is that composition within the scope of the above, the particles of which comprise about 45% by weight of a polymeric first stage, about 45% by weight of a polymeric second stage, and about 10% by weight of a polymeric third stage, wherein (1) the first monomer composition consists essentially of
  (a) about 86% by weight of butyl acrylate,
  (b) about 6% by weight of methyl methacrylate,
  (c) about 7% by weight of methacrylamide, and
  (d) about 1% by weight of itaconic acid;
(2) the second monomer composition consists essentially of
  (a) about 57% by weight of butyl acrylate,
  (b) about 35% by weight of methyl methacrylate,
  (c) about 7% by weight of methacrylamine, and
  (d) about 1% by weight of itaconic acid; and
(3) the third monomer composition consists essentially of methyl methacrylate.

Preferably, only a "latent crosslinking monomer", meaning a polyfunctional monomer wherein a portion of the functionality enters into copolymerization with other monomers in the monomer composition and the residual functionality causes "crosslinking" (that is, interaction or association) between the polymer stages upon subsequent complete drying, is used and no polyethylenically unsaturated monomer which crosslinks during initial polymerization is included in the monomer compositions. The type of functionality selected to provide "latent cross-linking", appears to provide sufficient interaction which prevents the polymer from becoming completely molten but still permits development of the required "nerve" mentioned above. Although the mechanism of this interaction is not fully understood, this interaction appears to be well-established and is a critical element of the invention. A completely crosslinked system, which can be achieved only by the addition of conventional crosslinking monomer, does not achieve the objects of the invention. The latent crosslinking monomer is selected from acrylamide and methacrylamide and is used in the amounts of 4–10% by weight in the first and second monomer compositions. Preferably, about 7% by weight of methacrylamide is used.

The $T_g$ of the first and second stage polymer compositions are determinable in a known manner either experimentally or by calculation. The method of calculating the $T_g$ based upon the $T_g$ of homopolymers of individual monomers is described by Fox, *Bull Am. Physics Soc.*, 1, 3, 123 (1956). Examples of $T_g$ of the homopolymers which permit such calculations are the following:

| HOMOPOLYMER OF | Tg |
|---|---|
| n-octyl acrylate | −80° C. |
| n-decyl methacrylate | −60° C. |
| 2-ethylhexyl acrylate | −70 ° C. |
| octyl methacrylate | −20° C. |
| n-tetradecyl methacrylate | 9° C. |
| methyl acrylate | 9° C. |
| n-tetradecyl acrylate | 20° C. |
| methyl methacrylate | 105° C. |
| acrylic acid | 106° C. |

Monomers may be selected to obtain the appropriate $T_g$ through use of the "Rohm and Haas Acrylic Glass Temperature Analyzer", publication CM-24L/cb of Rohm and Haas Company, Philadelphia, Penn.

The heteropolymer compositions are prepared by emulsion polymerization techniques based on a two-stage polymerization and gradual addition of the monomer emulsions in each of the two stages. While it is advantageous to initiate and catalyze the reaction in each stage in a conventional manner, wherein the initiator is activated either thermally or by a redox reaction, thermal initiation is preferred from the standpoint of better storage stability of the resulting polymer emulsion and balance of properties as a textile treating resin. The latex particles size should be relatively small, of the order of about 300 nm or less, preferably about 150–200 nm. As is well-known, given the same polymer backbone, particle size is controlled primarily by the type and level of emulsifier used in each stage of the emulsion polymerization. Molecular weight of the heteropolymers generally is of the order of about 70,000 to 2,000,000, preferably about 250,000 to 1,000,000.

The foregoing and other aspects of two-stage heteropolymer emulsion polymerization are well-known as described, for example, in U.S. Pat. Nos. 3,812,205, 3,895,028, 3,461,188 and 3,457,209 except for the critical monomer selection described herein.

The polymers may be conveniently isolated (and then dried) by either of two methods. The first method, freeze drying, has the advantage that it permits isolation of the polymer at low temperature and thereby minimizes any premature interaction within the polymer. For example, a Vir-Tis Freeze Drying Apparatus may be used. More particularly, a given polymer may be freeze-dried using this apparatus by diluting 400 g of the emulsion to 25% T.S., placing the diluted mixture in a 2-l. round bottom flask, swirling the mixture in an acetone-dry ice bath until the emulsion mixture is frozen, and then connecting the flask to the freeze drying apparatus and maintaining the system under reduced pressure. Ordinarily, after about 16 hours of being exposed to the freeze-drying apparatus under reduced pressure, the polymer is obtained in dry particulate form. While desirable for use with small quantities of polymer emulsion, the freeze-dry method would not be practical for large-scale operation.

For larger-scale operation, the "coagulation" method of isolating the polymers is used. Effective coagulation can be achieved by a salt coagulation technique using a 0.59% aqueous solution of aluminum sulfate adjusted to 35° C. While maintaining effective agitation, the polymer emulsion, maintained at 35° C., is slowly added up to a concentration of 35 parts emulsion per 100 parts of salt solution. The temperature is critical in that temperatures lower than 35° C. give a very fine coagulum which is difficult to filter and temperatures higher than 35° C. appear to result in pre-mature crosslinking and non-calenderable polymer is obtained. Alternatively, coagulation can be achieved by adding a cationic surfactant, for example Hyamine 3500® (available from the Rohm and Haas Company), to a diluted polymer emulsion. In either case, the resulting coagulum can be isolated on a Buchner funnel, washed, and then dried (for example, airdried for several days, vacuum dried, or forced air at relatively low temperatures such as 100° C).

Films or sheets of the multiple-stage polymer, or heteropolymer, of the invention may be prepared by calendering the dried heteropolymer and the films may then be stored in rolls or applied in the calendering operation of any form of textile fabric to obtain a variety of useful textile articles. In one end use application, the calendered heteropolymer may be used as a transfer film which is laminated with an adhesive to a suitable fabric in the manufacture of upholstery materials. The adhesive in such application may be any known adhesive useful for adhering acrylic films to fabrics. For example, the adhesive may be in the form of a dry, crushed foam acrylic latex coating, as set forth in Hoey, U.S. Pat. Re. No. 28,682 reissued Jan. 13, 1976, applied to a fabric substrate. The calendered heteropolymer film of this invention may then be applied as a top film to the adhesive-bearing adhesive-fabric composite to provide a laminated upholstery material.

The following examples illustrate but a few embodiments of the invention. All parts and percentages are by weight unless otherwise indicated. The abbreviations used have the following meaning:

| | |
|---|---|
| SLS = sodium lauryl sulfate | SSF = sodium sulfoxylate formaldehyde |
| BA = butyl acrylate | t-BHP = t-butyl hydroperoxide |
| MMA = methyl methacrylate | VAc = vinyl acetate |
| MAM = methacrylamide | MPA = mercapto propionic acid |
| AM = acyrlamide | AA = acrylic acid |
| IA = itaconic acid | MAA = methacrylic acid |
| ME = monomer emulsion | MIMAM = N-methylol-methacrylamide: methacrylamide (1:1) |
| NaPS = sodium persulfate | MIAM = N-methylol acrylamide:acrylamide (9:1) |
| Sty = styrene | ALMA = allyl methacrylate |

EXAMPLE 1 —PREPARATION OF HETEROPOLYMER a. (38.7 BA/2.7 MMA/3.15MAM/0.45IA)/(25.7BA/15.7MMA /3.15MAM/0.45IA)/10 MMA

The following ingredients are provided:

| Monomer Emulsions | I | II | III |
|---|---|---|---|
| SLS (28%) | 295.2g | 295.2g | 34.4g |
| $H_2O$ | 3983.Oml | 3983.0ml | 1920.40ml |
| BA | 7485.44g | 4961.28g | 0 |
| MMA | 522.24g | 3046.40g | 1936.0g |
| MAM | 609.28g | 609.28g | 0 |
| IA | 87.04g | 87.04g | 0 |
| $H_2O$ (rinse) | 140ml | 140ml | 80ml |
| Initial Charge | | | |
| SLS (28%) | 31.08g | | |
| $H_2O$ | 5000ml | | |
| ME #I | 400g | | |
| NaPS/$H_2O$ | 29.2g/208 | | |
| Cofeed Catalyst | | | |
| NaPS/$H_2O$ | 29.2g/1952ml | | |
| Charge III Catalyst | | | |
| $FeSO_4 . H_2O$ (0.15% in $H_2O$) | 80ml | | |
| t-BHP/$H_2O$ | 8g/56ml | | |
| SSF/$H_2O$ | 6.96g/160ml | | |
| Chaser Catalyst | | | |
| t-BHP/$H_2O$ | 8g/56ml | | |
| SSF/$H_2O$ | 6.4g/106ml | | |

To a suitable reaction vessel there is added the Initial Charge and the temperature of the charged reaction vessel is maintained at 80–86° C. After about 10–15 minutes, the remainder of ME #I and 976 ml of the Cofeed Catalyst are gradually added with stirring over a period of about 90 minutes. After 30 minutes, ME #II and 976 ml of the Cofeed Cataylst are gradually added with stirring over a period of about 90 minutes. After about 30 minutes, the charged reaction vessel is cooled to about 60° C. and ME #III is added in one portion. After about 20 minutes Charge III Catalyst is added while maintaining the temperature at about 55–60° C. Upon completion of this addition, the reaction mixture is stirred for about fifteen minutes and then the Chaser Catalyst is added. After allowing the reaction mixture to stir for about 15 minutes, the mixture is allowed to cool to room temperature and then it is filtered. The product is characterized as follows:

| Solids | Gum | Particle Size (u) B/G/R | pH | Viscosity, #2/60 |
|---|---|---|---|---|
| 50.7% | 2.8g | .139/.144/.145 | 4.5 | 161 cps |

EXAMPLE 1.b.

Following substantially the above-described procedure except for the selection of the particular monomers and their proportions, the following polymers can be prepared:

(1) (38.7BA/2.7MMA/3.15 MAM/1IA)//(23.4BA/18-MMA/3.15MAM/ 0.45IA)//10MMA (2) (38.7BA/2.7MMA/3.15MAM/1IA)//(21.1-5BA/20.25MMA/ 3.15MAM/0.45IA)//10MMA (3) 32.85BA/4.95MMA/3.15MAM/1IA//25.6-5BA/15.75MMA/3.15MAM/0.45IA//10MMA (4) 34.2BA/7.2MMA/3.15MAM/1IA//25.6-5BA/15.75MMA/3.15MAM/0.45IA//10MMA

EXAMPLE 2—COMPARATIVE CALENDERABILITY OF ACRYLIC POLYMERS

The following acrylic polymers are produced by emulsion polymerization, dried, isolated, and calendered on a two roll mill calendering apparatus consisting of two 10″×15″steam heated rolls. The results are summarized in Table I.

| Polymer | Composition |
|---|---|
| A | Example 1.a. (above) |
| B | 95 (66EA/32.7MMA/1.3MMA)/5(66EA/31MMA/1MMA/ 2 N-([beta-(alpha-methacryloxyacetamido) ethyl])-ethylene urea) |
| C | 66EA/31MMA/1MMA/2 N-([beta-(alpha-methacryloxy-acetamido)ethyl])-ethylene urea |
| D | 58BA/39.5VAc/1.8IA/0.7AA |
| E | 68BA/30MMA/7M1MAM/1IA |
| F | 47.75EA/47.75BA/3AM/1.5IA/0.05MPA |
| G | 43BA/2.5MMA/3.5MAM/0.5ALMA/1IA//27.5BA 17.5MMA/3.5MMA/3.5M1MAM/0.5IA |
| H | 43BA/3MMA/3.5MAM/0.5IA//28.5BA/17.7MMA/ 3.5M1MAM/0.5IA |
| J | 75 Polymer F/25 Polymer B |
| K | 43BA/3MMA/3.5MAM/0.5IA//28.5BA/ 17.5MMA/3.5MAM/0.5IA |
| L | 38.7BA/2.7MMA/3.15MAM/0.45IA//25.7BA/ 15.7MMA/3.15MAM/0.45IA/10MMA + 0.2MPA |
| M | 38.7BA/3.7MMA/3.15MAM/0.45IA//25.65BA/ 15.75MMA/3.15M1MAM/0.45IA//10MMA |

TABLE I

Calenderability of Acrylic Polymers

| Polymer | T300[a] | Nominal Roll Temp.,(°F.) | Fluxing Aids | Comments |
|---|---|---|---|---|
| A | 0 | 215 | b | Very good film at thickness of 1.5 mil and greater |
| B | (+)16 | 300 | b | No film formation, gummy |
| B | (+)16 | 210 | b | No film formation, gummy, stalling mill |
| C | (+)7 | 300 | b | No film formation, gummy |
| C | (+)7 | 210 | b | No film formation, gummy |
| D | (−)9 | 210 | b | Tacky, sticking to both rolls |
| E | (−)8 | 300 | b | "Cheezy" opaque film, little fluxing |
| E | (−)8 | 360 | b | "Cheezy" opaque film, little fluxing |
| E | (−)8 | 210 | b | "Cheezy" opaque film, little fluxing |
| F | (−)18 | 290 | b | Fluxed well, film tacky and gummy |
| F | (−)18 | 220 | b | No film formation |
| G | (−)8 | 300 | b | Sluggish fluxing, poor film, opaque |
| G | (−)8 | 220 | b | Sluggish fluxing, poor film, opaque |
| H | (−)8 | 300 | b | "Cheezy" opaque film |
| H | (−)8 | 220 | b | "Cheezy" opaque film |
| J | (−)8 | 220 | b | Gummy, no film formation |
| K | (−)8 | 300 | b | Tacky film; holes in film; fluxed well |
| K | (−)8 | 215 | b | Less tacky film, good film thickness of 4 units and greater |
| L | 0 | 215 | b | Fluxed well, film somewhat tacky |
| M | 0 | 215 | b | Fluxed poorly; poor film quality; slight roll sticking |

[a]$T_{300}$ = glass transition temperature °C.
[b]4% Harshaw W-701[R] carbon black + 4% stearic acid + 4% polymeric processing aid (36MMA/4EA/2-4BA/36Sty); post added The results in Table I indicate that highly thermoplastic acrylic polymers, for example Polymer B, merely soften and become gummy without developing any useful film properties or characteristics when introduced into a calendering apparatus.

Also, polymers having a relatively high degree of crosslinking resulting from the use of methylolacrylamide provide weak film properties, apparently due to poor film coalescence resulting from excessive crosslinking. In this regard, reference is made to Polymers E, G, H, and M.

Polymer F demonstrates that high molecular weight is important. While this polymer has functionality similar to that of the polymers of the invention, no interpolymer interactions occur and the polymer remains gummy on the calender as a result of its low molecular weight.

Polymer K shows improvement over Polymer F in that the film fluxed well and is less tacky.

Polymer A, according to the invention, provides very good film formation in the range of thickness 1.5–10 mils. Especially advantageous is the observation that this polymer can be calendered successfully at a roll temperature of 215° F., which temperature is substantially below the 300–400° F. temperature range required in calendering PVC and related vinyl polymer systems. Processing of Polymer A at higher temperatures resulted in increased tack in the film. The use of mercapto propionic acid in the polymerization of the monomers of Polymer A to provide lower molecular weight resulted in increased tack in the film (Polymer L). Polymer M is a repeat of Polymer A.

EXAMPLE 3 —PERFORMANCE PROPERTIES OF CALENDERED ACRYLIC FILM

Composites are prepared by casting a foam produced from Polymer F above on woven and non-woven fabric substrate at a level of 6–8 dry ounces per square yard and then drying the foam coated fabric. For a comparative study, films are produced from Polymer A both by emulsion casting and by calendering the dried and isolated polymer. The respective films are applied to the foam surface of the intermediate foam-fabric composite and thereafter the foam layer is crushed by passing the film-covered intermediate foam-fabric composite through embossing plates. Samples of the film-covered, crushed foam-coated fabric are cured by exposure thereof to a temperature of 300° F. for four minutes. The test results, which are summarized in Table II, show that the polymer according to the invention adequately fluxes and flows on a calender and provides a film which duplicates an emulsion cast film of the same polymer, which represents maximum film formation.

TABLE II

Composites of acrylic Film-Covered Fabrics

| Property | Emulsion Casted Film[a] | Calendered Film[a] |
|---|---|---|
| Tensile Strength, psi (film only) | 540 | 490 |
| Elongation, % (film only) | 415 | 325 |
| Taber Abrasion, H-18/500g/1000 cycles (ASTM D-1175-71) | 45 | 59 |
| Blocking | 3 | 2 |
| Bally Flex (cycles) (Society Leather Technologists and Chemists Method SLP-14) | 400,000 | 350,000 |
| Stoll Flex (cycles) (Federal Test Method Std. No. 191, Method 5300, using 616 tension and 0.5lb pressure) | 200 | 200 |
| Newark Seam Tear (cycles) (ASTM D-2097-69) | 325,000 | 300,000 |
| Hoffman Scratch (g) | | |
| One Eye Twill | 700 | 1,800 |
| Napped and Sheared | 1,600 | 2,000 |
| Wyzenbeek Abrasion (cycles) (ASTM D-1175-64) | 25,000 | 45,000 |
| Cold Crack (°F.) | (−)15 | (−)15 |

[a]film thickness = 2.5–3 mils

What is claimed is:

1. A calenderable, soft, three-stage acrylic polymeric composition, said composition having a calculated $T_g$ of from about (−)40° C. to about (+)20° C., the isolated and dried particles of which comprise about 30–60% by weight of a polymeric first stage, about 30–60% by weight of a polymeric second stage, and about 5–20% by weight of a polymeric third stage, wherein (1) said first stage is formed by emulsion polymerization of a first monomer composition having a $T_g$ of about (−)10°. or lower consisting essentially of:
(a) about 70–95% by weight of at least one ($C_1$–$C_8$) alkyl acrylate,
(b) about 0–15% by weight of at least one ($C_1$–$C_8$) alkyl methacrylate,
(c) about 4–10% by weight of a latent cross-linking monomer selected from acrylamide or methacrylamide, and
(d) about 0.5–4% by weight of at least one alpha, beta-ethylenically unsaturated carboxylic acid selected from acrylic acid, methacrylic acid, and itaconic acid;

(2) said second stage is formed by emulsion polymerization, in the presence of said first stage, of a second monomer composition having a $T_g$ of about (−)10 to (+)60° C. consisting essentially of:
(a) about 40–70% by weight of at least one ($C_1$–$C_8$) alkyl acrylate,
(b) about 20–50% by weight of at least one ($C_1$–$C_8$) alkyl methacrylate,
(c) about 4–10% by weight of a latent cross-linking monomer selected from acrylamide and methacrylamide, and
(d) about 0.5–4% by weight of at least one alpha, beta-ethylenically unsaturated carboxylic acid selected from acrylic acid, methacrylic acid, an itaconic acid; and (3) said third stage is formed by emulsion polymerization, in the presence of said second stage polymerization product, of a third monomer composition consisting essentially of:
(a) about 50–100% by weight of methyl methacrylate, and
(b) about 0–50% by weight of a comonomer selected from those comonomers copolymerizable with methyl methacrylate and having a calculated $T_g$ of less than (−)25° C.

2. A composition according to claim 1 wherein (1) the first monomer composition consists essentially of
(a) about 76–86% by weight of butyl acrylate,
(b) about 6–15% by weight of methyl methacrylate,
(c) about 7% by weight of methacrylamide, and
(d) about 1% by weight of itaconic acid;

(2) the second monomer composition consists essentially of
(a) about 47–57% by weight of butyl acrylate,
(b) about 35–45% by weight of methyl methacrylate,
(c) about 7% by weight of methacrylamide, and
(d) about 1% by weight of itaconic acid; and (3) the third stage monomer composition consists essentially of methyl methacrylate.

3. A composition according to claim 1, the isolated and dried particles of which comprise about 45% by weight of a polymeric first stage, about 45% by weight of a polymeric second stage, and about 10% by weight of a polymeric third stage, wherein (1) the first monomer composition consists essentially of
(a) about 86% by weight of butyl acrylate,
(b) about 6% by weight of methyl methacrylate,
(c) about 7% by weight of methacrylamide, and
(d) about 1% by weight of itaconic acid;

(2) the second monomer composition consists essentially of (a) about 57% by weight of butyl acrylate,
(b) about 35% by weight of methyl methacrylate,
(c) about 7% by weight of methacrylamide, and
(d) about 1% by weight of itaconic acid; and (3)the third monomer composition consists essentially of methyl methacrylate.

4. A process for producing a film or sheet comprising calendering the composition of claim 1, claim 2, or claim 3.

5. An article of manufacture comprising a film or sheet produced by calendering the composition of claim 1 or claim 2 or claim 3.

6. An article of manufacture comprising a textile material treated with the calendered composition according to claim 1.

7. An article according to claim 6 wherein the textile material is produced from cotton, wool, nylon, polyester, or polyacrylamide material and the polymeric treating composition is applied as a polymeric film or sheet to the textile material in the calendering operation.

8. An article according to claim 7 further including a crushed foam layer between the textile material and the coating.

9. A process which comprises treating a textile material with the calendered film having the composition of claim 1.

10. A process which comprises covering a textile material with a crushed foam layer, covering the crushed foam covered material with a calendered film having the composition of claim 1, and curing the polymeric film covering.

* * * * *